US005583396A

United States Patent [19]

Hideaki et al.

[11] Patent Number: 5,583,396

[45] Date of Patent: Dec. 10, 1996

[54] OPTICAL DEVICE WITH METAL HALIDE DISCHARGE LAMP HAVING ENHANCED STARTING PROPERTY

[75] Inventors: Omura Hideaki, Ibaraki; Masayuki Wakamiya, Suita; Nobuyoshi Takeuchi, Osaka; Munehiro Tabata, Ibaraki, all of Japan

[73] Assignee: Matsushita Electric Industrial Co., Ltd., Osaka-fu, Japan

[21] Appl. No.: 214,193

[22] Filed: Mar. 17, 1994

[30] Foreign Application Priority Data

Mar. 18, 1993 [JP] Japan ..... 5-058978
Sep. 28, 1993 [JP] Japan ..... 5-241714

[51] Int. Cl.[6] ..... H05B 37/00

[52] U.S. Cl. ..... 315/106; 315/107; 315/360

[58] Field of Search ..... 315/56, 106, 107, 315/112, 291, 358, 360; 353/85

[56] References Cited

U.S. PATENT DOCUMENTS

| | | | |
|---|---|---|---|
| 4,215,292 | 7/1980 | Inui et al. | 315/98 |
| 4,642,525 | 2/1987 | Widmayer | 315/219 |
| 4,791,338 | 12/1988 | Dean et al. | 315/174 |
| 5,056,912 | 10/1991 | Hamada et al. | 353/38 |
| 5,355,187 | 10/1994 | Ogino et al. | 353/38 |

FOREIGN PATENT DOCUMENTS 5-182775 7/1993 Japan .

OTHER PUBLICATIONS

"Problems Unique to Metal Iodide Arc Lamps", MIT Press 1971, pp. 254–258.

*Primary Examiner*—Robert Pascal
*Assistant Examiner*—David H. Vu
*Attorney, Agent, or Firm*—Wenderoth, Lind & Ponack

[57] ABSTRACT

A metal halide lamp is employed, as a light source, in an optical device such as, for example, an illuminator or an image display. The optical device includes a discharge tube filled with mercury, at least one rare gas, and at least one metal halide, and a pair of electrodes spaced from each other and enclosed in the discharge tube. The optical device also includes an electric circuit, electrically connected to the pair of electrodes, for starting the discharge tube by applying thereto a higher voltage than a voltage to be applied at a steady state to thereby cause an arc discharge in the discharge tube. When the lamp is turned off, power supply thereto from the electric circuit is temporarily interrupted, and when the lamp cools after a first time interval has elapsed subsequent to the interruption of the power supply, a starting voltage is applied to the lamp via the pair of electrodes for a second time interval to cause redischarge. Thereafter, the power supply to the lamp is interrupted after the second time interval has elapsed, to thereby turn off the lamp.

8 Claims, 4 Drawing Sheets

OPTICAL DEVICE WITH METAL HALIDE DISCHARGE LAMP HAVING ENHANCED STARTING PROPERTY

BACKGROUND OF THE INVENTION

1. Field of the Invention

The present invention relates generally to an optical device employing a metal halide lamp as a light source and, more particularly, to an illuminator with a metal halide lamp having an enhanced starting property and also to an image display such as, for example, a projector employing the above illuminator.

2. Description of Related Art

Metal halide lamps, filled with metal halides such as, for example, dysprosium iodide, neodymium iodide, or cesium iodide, rare gas such as, for example, argon gas as auxiliary starting gas, and mercury, generally have superior luminous characteristics, a relatively high luminous efficacy, and a high durability. For this reason, the metal halide lamps are in wide practical use today for indoor and outdoor lighting and in various image displays such as, for example, liquid crystal projection type displays and projectors including an overhead projector (OHP).

Operating the metal halide lamps which make use of luminescence of the encapsulated materials in the arc discharge requires an electric circuit (generally including a starter and a ballast) for starting and stably maintaining the discharge. By way of example, in the case of a 150-W metal halide lamp, the circuit therefor is designed so as to provide a lamp voltage of about 85 volts and a lamp current of about 1.78 amperes after reaching a steady light-up condition.

A higher voltage than the rated lamp voltage is, however, required to initiate the discharge in the metal halide lamp. The reason for this is that metal halides, mercury halides, free halogen gas and like materials in the metal halide lamp tube capture electrons in the discharge space, as can be known from, for example, "Electric Discharge Lamps" (MIT Press 1971, pp254) written by J. F. Waymouth. Accordingly, the circuits for metal halide discharge lamps generally have equipment for generating a high voltage necessary to initiate the discharge. With such equipment, a high voltage of about 10 kilovolts is applied to the lamp for about 2 seconds at a frequency of 100 Hz, for example, only at the starting of the lamp.

The application of such high voltage of about 10 kilovolts to the lamp, even though only at the starting, occasionally causes a problem associated with safety. Unless a sufficient distance is ensured between a power feeder line to the lamp and neighboring components, there arises a problem such as, for example, damage of the components, electric shock, or the like at the time of applying the high voltage. Considering humidity, the power feeder line to the lamp must be sufficiently spaced away from the neighboring components.

Furthermore, it is necessary to make the circuit of the metal halide lamp as small as possible, because the circuit is in most cases accommodated in an instrument or installed at a high position. Conventional circuits for the metal halide lamps could not satisfy both the requirement to reduce the size thereof and the requirement for safety. In order to cope with both the safety factor and the cost factor, it is desired to minimize the voltage required for starting the lamp.

Especially in image displays such as, for example, OHPs or liquid crystal projectors which should be small-sized and portable, it is necessary to reduce the starting voltage of the lamp.

SUMMARY OF THE INVENTION

The present invention has been developed to overcome the above-described disadvantages and is intended to provide an optical device such as, for example, an illuminator or an image display employing a metal halide lamp as a light source, which can be started at a reduced voltage and has improved safety.

Another objective of the present invention is to provide the optical device of the above-described type which has a simple construction and can, hence, be configured into a reduced size.

In accomplishing the above and other objectives, an illuminator according to the present invention comprises a discharge tube filled with mercury, at least one rare gas and at least one metal halide, a pair of electrodes spaced from each other and enclosed in the discharge tube, and an electric circuit (generally including a starter and a ballast) electrically connected to the pair of electrodes for starting the discharge tube by applying thereto a higher voltage than a voltage to be applied at a steady state to thereby generate an arc discharge in the discharge tube.

When the lamp is turned off, power supply thereto from the electric circuit is temporarily interrupted. However, when the lamp cools down to a predetermined temperature after a first time interval has elapsed subsequent to the interruption of the power supply, a starting voltage is applied to the lamp via the pair of electrodes for a second time interval to cause redischarge. Thereafter, the power supply to the lamp is interrupted after the second time interval has elapsed, to thereby turn off the lamp.

This illuminator can be incorporated in an image display. In this case, the image display comprises a focusing optical unit carrying the lamp, a projection unit spaced away from the focusing optical unit, and a light receiving plane spaced away from the projection unit.

In the image display of the above-described construction, light emitted from the discharge tube is focused by the focusing optical unit and is then projected onto the light receiving plane through the projection unit.

Preferably, the rare gas is argon gas having a partial pressure within the range of 0.1 to 1000 Torr.

Advantageously, the second time interval is chosen to be less than 10 seconds.

In another aspect of the present invention, a method of turning the metal halide lamp off comprises the steps of:

interrupting power supply to a metal halide lamp discharge tube in which arc discharge takes place;

cooling the discharge tube for a first time interval;

applying a starting voltage to the discharge tube for a second time interval to cause redischarge therein; and interrupting power supply to the discharge tube.

According to the present invention, the discharge starting voltage of the metal halide lamp is reduced for the following reasons.

Consider that the metal halide lamp is under a steady state operation after the arc discharge has taken place therein. When the power supply from the electric circuit to the lamp is interrupted, light emission from the lamp stops and the lamp temperature goes down. Hereupon, further consider the materials of the lamp. The discharge tube is made of glass such as, for example, quartz glass, while the electrodes are made of metal consisting principally of tungsten. The thermal conductivity of metal is greater than that of glass. So, when the lamp is turned off, there occurs a rapid decrease in the temperature of the electrodes as compared with that of the discharge tube. Accordingly, mercury and metal halide additives encapsulated in the arc tube, taking the form of gas or liquid when the lamp is being burnt, return to liquid or solid state at ordinary temperatures, respectively, and adhere not only to the inside wall of the discharge tube but to the electrodes. When the lamp is turned off and cools enough, it can be readily confirmed that mercury, mercury halide, metal halides and like materials actually adhere to the electrodes, even with the naked eye.

According to the present invention, the deposits, having adhered to the electrodes in the cooling process of the lamp, vaporize and adhere to the discharge tube wall when only the electrodes are heated by the redischarge for a relatively short period of time. Subsequent interruption of the voltage application and cooling of the lamp cause little adhesion of mercury, mercury halide, metal halides and like materials onto the electrodes. Accordingly, when the lamp is next turned on, the electrodes are almost free from any deposit.

It has been known that the starting property of the metal halide lamp is improved with electrodes having no deposits rather than with those having some deposits thereon. This has been reported, for example, by W. W. Byszewski, et al. in "Journal of the Illuminating Engineering Society (1990, pp70)".

It is considered that the presence of the deposits on the tips of the electrodes changes a work function of the electrodes. Under certain circumstances, the voltage to start discharge with the electrodes having no deposits is lower than with those having some deposits thereon.

Furthermore, the starting voltage required to redischarge the metal halide lamp for a short period of time in the cooling process of the lamp to thereby vaporize the deposits on the electrodes is lower than that required to initiate discharge in the lamp completely cooled to an ordinary temperature. The reason for this is that the so-called Penning effect between argon gas and mercury vapor effectively functions and reduces the discharge starting voltage if the vapor pressure of mercury falls within a specific range depending on the partial pressure of argon gas. When the partial pressure of argon gas falls within a specific range, the vapor pressure of mercury increases at higher temperatures than ordinary ones, making it possible to render the Penning effect to effectively function and reduce the discharge starting voltage.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

Figure 1:
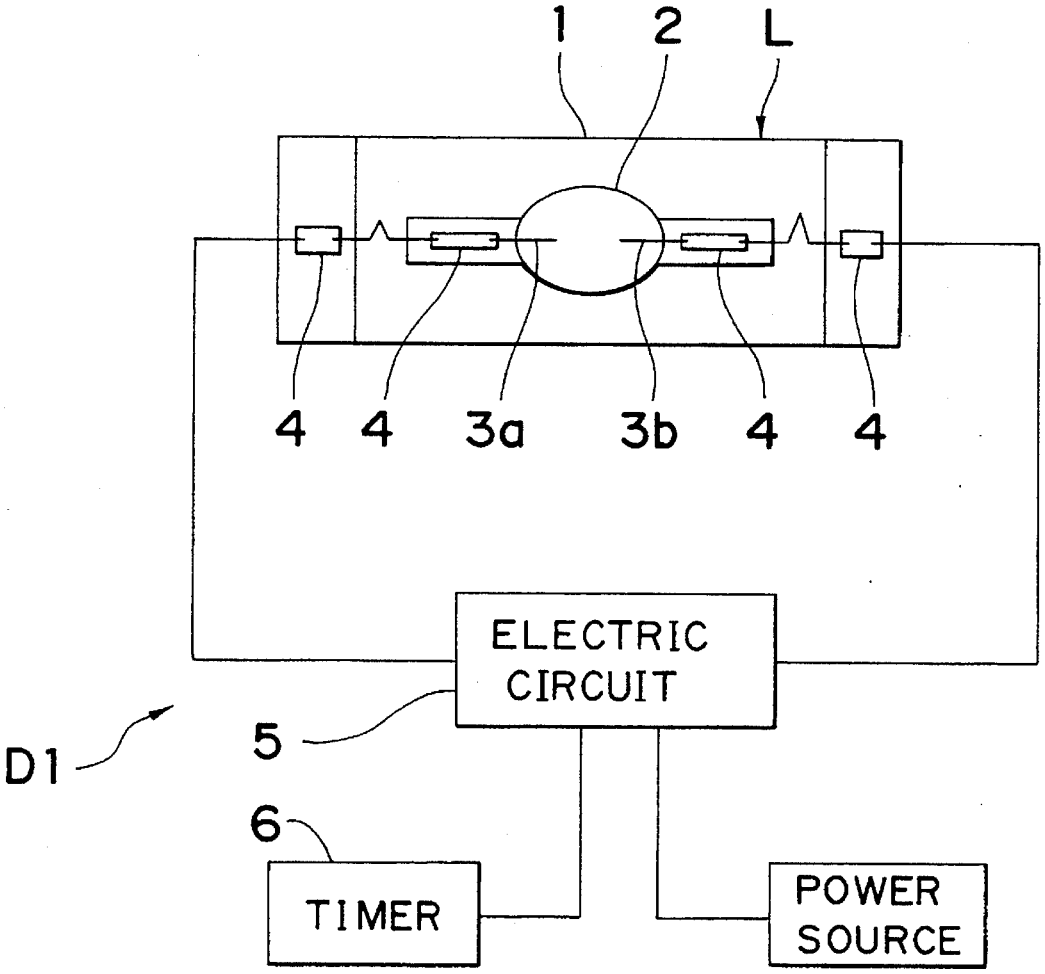
FIG. 1 is a schematic diagram of an illuminator with a metal halide lamp according to a first embodiment of the present invention.

FIG. 1 schematically depicts an illuminator D1 embodying the present invention. The illuminator D1 comprises a metal halide lamp L as a light source and an electric circuit 5 for generating and maintaining discharge in the metal halide lamp L. The metal halide lamp L comprises an envelope 1 enclosing a discharge tube 2. The discharge tube 2 has a pair of electrodes *3a* and *3b* made of, for example, tungsten, extending into the discharge tube 2. The electric circuit 5 is electrically connected with the electrodes *3a* and *3b* via respective pairs of foils 4 made of, for example, molybdenum and mounted in the metal halide lamp L, and a timer circuit 6.

The discharge tube 2 has a maximum external diameter of 14.2 mm, a wall thickness of 1.5 mm, and an internal volume of 0.95 cc. The metal halide lamp L has a rated lamp voltage of 250 watts. The discharge tube 2 is filled with a starting rare gas which is, in the illustrated embodiment, argon gas having a partial pressure of 10 Torr, 20 mg of mercury, 0.6 mg of dysprosium iodide, 0.5 mg of neodymium iodide, and 0.6 mg of cesium iodide. The length of arc, i.e., the distance between opposed tips of the paired electrodes *3a* and *3b* is 6.8 mm.

It is to be noted here that the argon gas may be replaced by any other suitable rare gas, or the discharge tube 2 may be filled with a mixture of two or more rare gases.

It is also to be noted that although in the above-described embodiment three kinds of metal halides are filled in the discharge tube 2, any other suitable metal halide or halides other than those referred to above may be employed.

In the illuminator D1 of the above-described construction, the metal halide lamp L is operated by the electric circuit 5 using a square wave having a frequency of 250 Hz.

Figure 2:
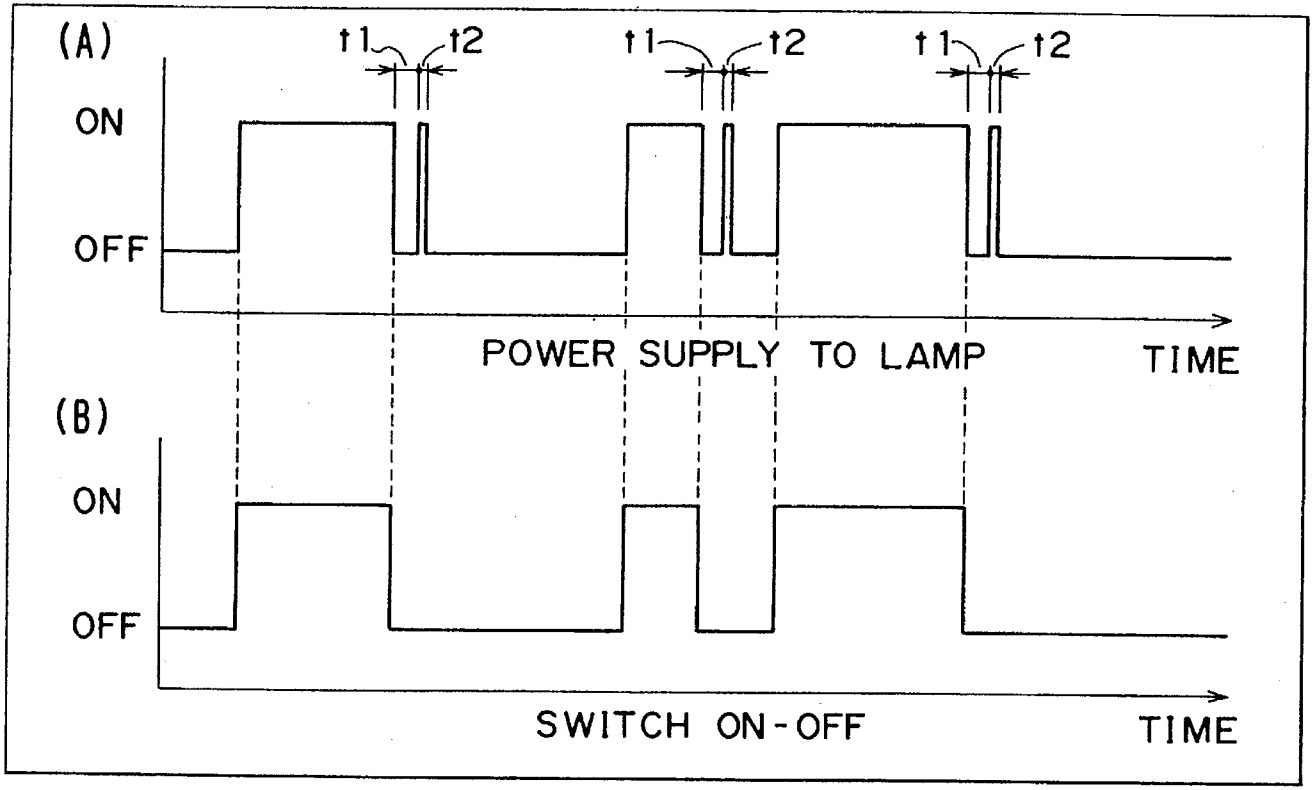
FIG. 2 is a timing chart indicating the relationship between switching on and off of the illuminator and power supply to the metal halide lamp.

FIG. 2 depicts a timing chart indicating the relationship between switch on-off of the illuminator D1 and power supply to the metal halide lamp L.

The instant the illuminator D1 is powered on by, for example, a manual switch (not shown), the electric circuit 5 supplies the metal halide lamp L with an electric power to turn the lamp on. The metal halide lamp L keeps operating until the circuit 5 is switched off. When the circuit 5 is switched off to interrupt the power supply to the metal halide lamp L, the metal halide lamp L is temporarily turned off. As shown in FIG. 2, after the elapse of a time interval t1 subsequent to the interruption of the power supply, the electric circuit 5 automatically supplies the metal halide lamp L with the electric power based on a signal from the timer circuit 6 even if the illuminator D1 is switched off. The power supply is continued for a time interval t2, during which the metal halide lamp L causes discharge again. After the elapse of the time interval t2, the power supply to the metal halide lamp L is interrupted and, hence, the metal halide lamp L cannot completely reach the condition in which steady arc discharge takes place. The power supply from the electric circuit 5 to the metal halide lamp L can be repeatedly carried out in the above-described manner.

An experiment was made to confirm the effect of the illuminator D1 of the present invention mentioned above.

Figure 4:
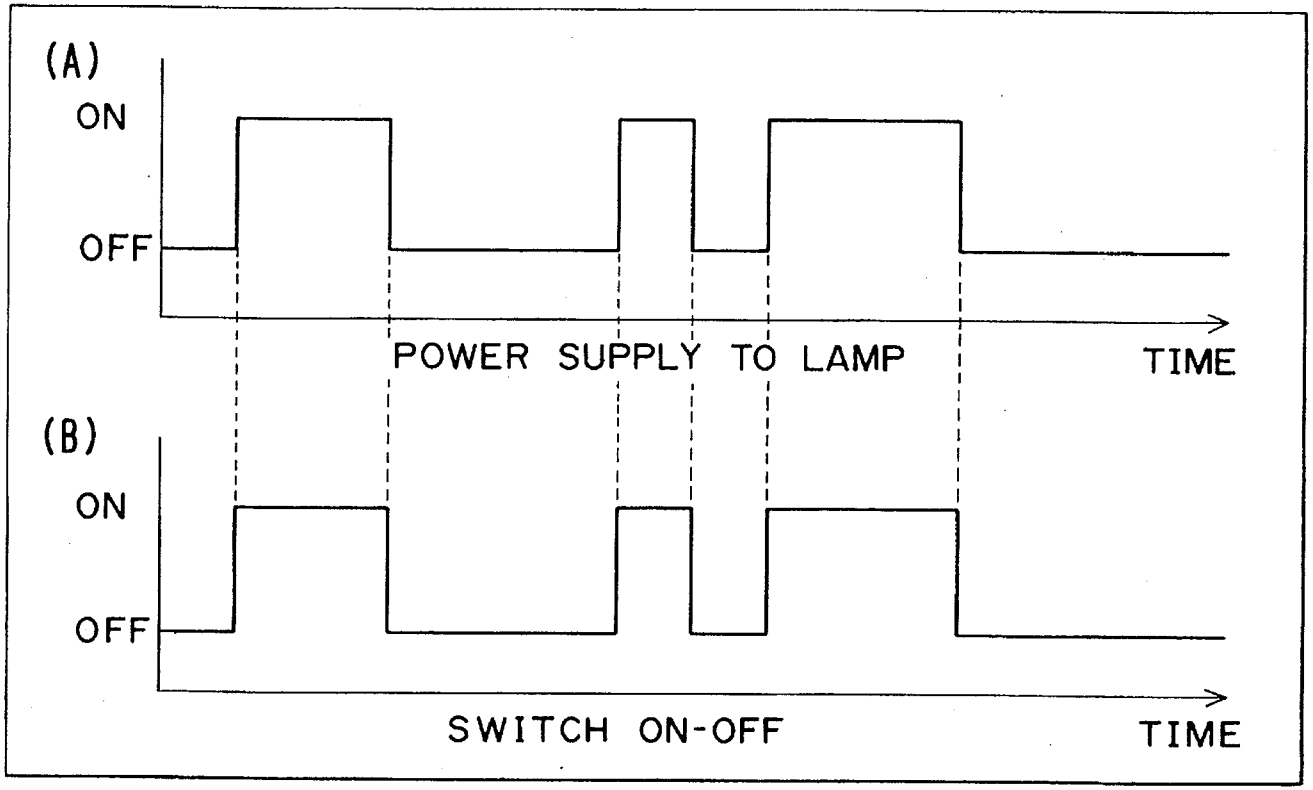
Fig. 4 PRIOR ART
FIG. 4 is a chart similar to FIG. 2, but indicating the relationship between the switching on and off of a conventional illuminator and the power supply to a metal halide lamp mounted therein.

The lamp starting voltage was measured using the circuit 5 of the present invention and a conventional circuit which operates as shown in a timing chart of FIG. 4. Tests were conducted to determine how many out of 250 lamps of an identical structure were successfully started with various voltages applied thereto. The starting voltage was applied to each lamp for about 2 seconds at 100 Hz. Table 1 shown below indicates the results of the measurements.

TABLE 1

| | Starting Probability (%) | |
|---|---|---|
| Start. Voltage (kV) | Conventional Ex. | Invention |
| 1.0 | 0 | 5 |
| 2.0 | 15 | 25 |
| 3.0 | 30 | 45 |
| 4.0 | 45 | 80 |
| 5.0 | 45 | 100 |
| 6.0 | 60 | 100 |
| 7.0 | 75 | 100 |
| 8.0 | 85 | 100 |
| 9.0 | 90 | 100 |
| 10.0 | 100 | 100 |

According to Table 1 above, the conventional illuminator required a voltage of 10 kilovolts or higher to start all of the lamps. On the other hand, the illuminator D1 of the present invention could start all of the lamps with as low as 5 kilovolts, i.e., half the voltage required by the conventional illuminator.

The use of the illuminator D1 of the present invention can reduce the voltage required to initiate discharge of the metal halide lamp and can improve the safety of operation. Furthermore, the illuminator D1 of the present invention can be made at a low cost.

Figure 3:
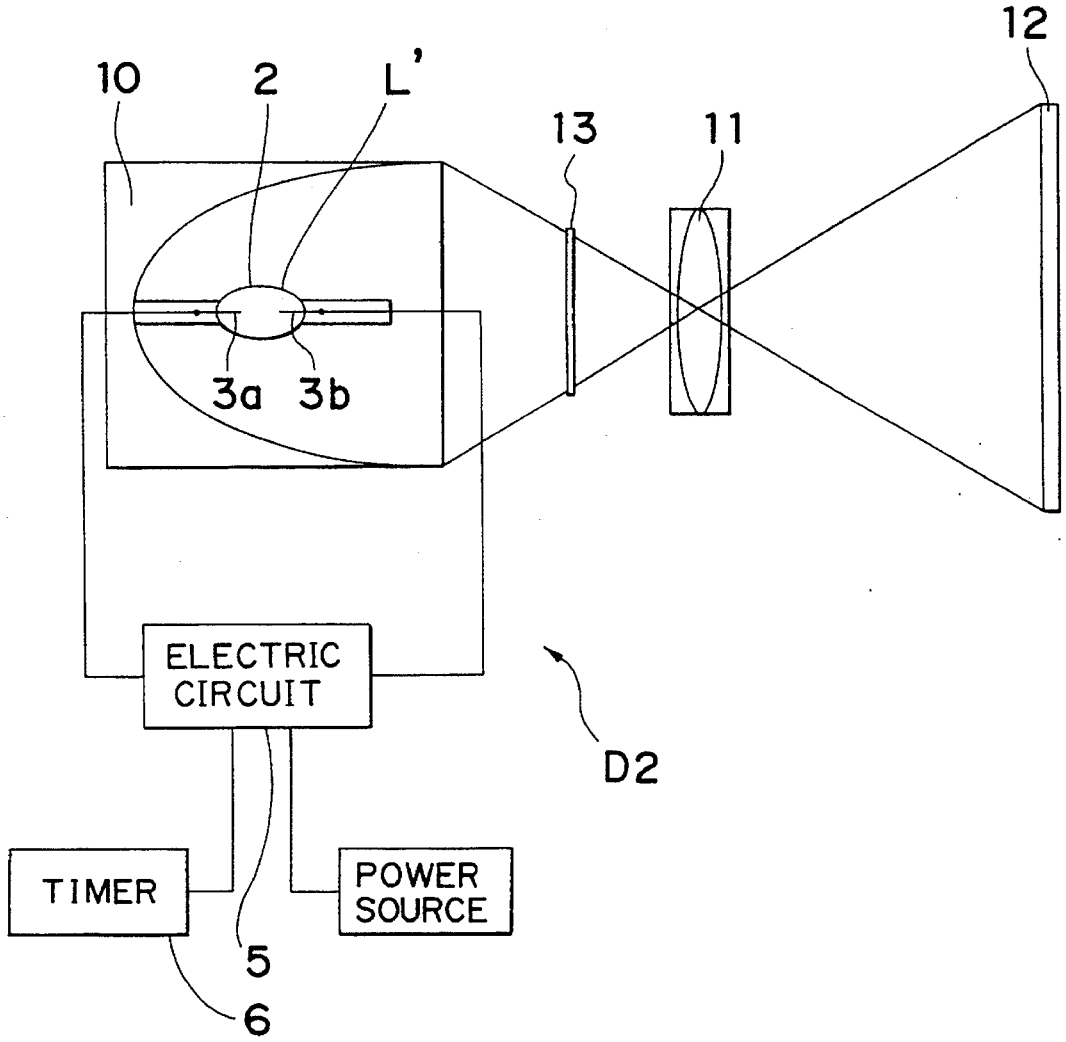
FIG. 3 is a schematic diagram of an image display with a metal halide lamp according to a second embodiment of the present invention.

FIG. 3 schematically depicts an image display D2 according to a second embodiment of the present invention.

As shown in FIG. 3, the image display D2 makes use of a metal halide lamp L' as a light source. This lamp L' comprises a discharge tube 2 with no envelope and an electric circuit 5 for starting the metal halide lamp L'. The discharge tube 2 includes a pair of electrodes 3*a* and 3*b* made of, for example, tungsten, extending into the discharge tube 2. The electric circuit 5 is electrically connected with the electrodes 3*a* and 3*b* via respective pairs of foils (not shown) made of, for example, molybdenum and mounted in the metal halide lamp L', and a timer circuit 6.

The image display D2 also comprises a focusing optical unit 10 including a reflection mirror or a condenser lens, a projection unit 11 including at least one lens and spaced away from the focusing optical unit 10, and a light receiving plane 12 which may be a screen and is spaced away from the projection unit 11. The metal halide lamp L' is placed in and carried by the focusing optical unit 10. Light emitted from the metal halide lamp L' is initially focused by the focusing optical unit 10 and is subsequently projected on the light receiving plane 12 through the projection unit 11.

In the case of the liquid crystal projector, for example, the image display D2 further comprises a liquid crystal panel 13 interposed between the metal halide lamp L' and the projection unit 11. In this case, an image displayed on the liquid crystal panel 13 is projected on the light receiving plane 12 on an enlarged scale.

The discharge tube 2 of the metal halide lamp L' has a maximum external diameter of 14.2 mm, a wall thickness of 1.5 mm, and an internal volume of 0.95 cc. The rated lamp power is 250 watts. This tube 2 is filled with argon gas having a partial pressure of 150 Torr which is employed as starting rare gas, 25 mg of mercury, 1.0 mg of dysprosium iodide, 0.8 mg of neodymium iodide, and 0.9 mg of cesium iodide. The distance between opposed tips of the paired electrodes 3*a* and 3*b* is 5.8 mm.

In the image display D2 of the above-described construction, the metal halide lamp L' is operated by the electric circuit 5 using a square wave having a frequency of 120 Hz. As is the case with the first embodiment, the power supply to the lamp L' is carried out in a manner as shown in the timing chart of FIG. 2.

An experiment similar to that in the first embodiment was conducted to confirm the effect of the image display D2 according to the second embodiment of the present invention.

The lamp starting voltage was measured using the image display D2 of the present invention which was operated in accordance with the timing chart of FIG. 2 and also using a conventional image display which was operated in accordance with the timing chart of FIG. 4. As is the case with the first embodiment, the number of lamps used was 250. The starting voltage was applied to each lamp for about 30 seconds at 20 Hz.

The result was the same as that in the first embodiment. More specifically, the conventional image display required a voltage of 10 kilovolts or higher to start all of the tested lamps. On the other hand, the image display D2 of the present invention could start all of the tested lamps L' with a voltage of 5 kilovolts, i.e., half the voltage required by the conventional display.

It can be readily understood from this result that the use of the image display D2 of the present invention can reduce the voltage required to initiate discharge of the metal halide lamp L' and can improve the safety of operation.

In the above-described embodiments, the time intervals t1 and t2 shown in FIG. 2 were chosen to be 100 seconds and 2 seconds, respectively. This means that after the lamp L or L' was turned off, the lamp L or L' was allowed to cool for 100 seconds (t1) and was supplied with electric power for 2 seconds (t2) along with a starting voltage for redischarge thereof. Because the power supply was interrupted after the elapse of the time interval t2, i.e., 2 seconds, the lamp L or L' did not completely reach the condition in which steady arc discharge took place.

Alternatively, the time interval t1 can be chosen to be 1 second. In this case, although the lamp L or L' does not sufficiently cool after the time interval of 1 second has elapsed subsequent to the switch-off of the lamp L or L', the application of the starting voltage thereto continues from then. The lamp L or L' gradually cools, and after the elapse of a certain time interval, redischarge takes place. After a given time interval has elapsed upon detection of the redischarge, the power supply to the lamp L or L' is interrupted.

If the time interval during which the redischarge takes place is prolonged, the temperature of both the electrodes 3*a* and 3*b* and the discharge tube 2 raises to such an extent to reduce the effect of the present invention. In order to vaporize deposits on the electrodes 3*a* and 3*b* and shift them onto the wall of the discharge tube 2, the redischarge time is limited so as not to appreciably raise the temperature of the discharge tube 2. For this reason, the redischarge time is appropriately chosen so as not to exceed 10 seconds.

In short, t1 and t2 should be determined so that the discharge tube 2 sufficiently cools and the redischarge is continued within a time period less than 10 seconds.

In applications where argon gas is used as rare gas such as in the above-described embodiments, or in applications where the encapsulated gases contain the argon gas, the argon gas is required to have a partial pressure within a predetermined range.

In order to make effective use of the Penning effect of mercury vapor and argon gas, it was confirmed that the effect of the present invention could be maximized by rendering the partial pressure of the argon gas to fall within the range of 0.1 to 1000 Torr.

It is to be noted that although, in the preferred embodiments mentioned above, the starting voltage has been described as applied to the lamp for 2 seconds at 100 Hz or for 30 seconds at 20 Hz, it has been confirmed that any other suitable high voltage application mode is effective.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. An illuminator comprising:

a metal halide lamp including a discharge tube filled with mercury, at least one rare gas and at least one metal halide, and a pair of electrodes spaced from each other and enclosed in said discharge tube;

an electric circuit, electrically connected to said electrodes, for supplying power to said metal halide lamp via said electrodes to generate and maintain an arc discharge in said discharge tube; and timer means electrically connected to said electric circuit for, upon turning off of said metal halide lamp, interrupting the power supply to said metal halide lamp for a first time interval to allow cooling of said metal halide lamp, then, upon expiration of said first time interval, causing the electric circuit to again supply power to said metal halide lamp for a second time interval to cause redischarge, and then, upon expiration of said second time interval, halting supply of power from said electric circuit to said metal halide lamp to thereby turn off said metal halide lamp.

2. An illuminator as recited in claim 1, wherein said at least one rare gas comprises argon gas having a partial pressure of 0.1 to 1000 Torr.

3. An illuminator as recited in claim 1, wherein said second time interval is less than 10 seconds.

4. An image display comprising:

a metal halide lamp including a discharge tube filled with mercury, at least one rare gas and at least one metal halide, and a pair of electrodes spaced from each other and enclosed in said discharge tube;

an electric circuit, electrically connected to said electrodes, for supplying power to said metal halide lamp via said electrodes to generate and maintain an arc discharge in said discharge tube;

a focusing optical unit carrying said metal halide lamp;

a projection unit spaced away from said focusing optical unit;

a light receiving plane spaced away from said projection unit; and timer means electrically connected to said electric circuit for, upon turning off of said metal halide lamp, interrupting the power supply to said metal halide lamp for a first time interval to allow cooling of said metal halide lamp, then, upon expiration of said first time interval, causing the electric circuit to again supply power to said metal halide lamp for a second time interval to cause redischarge, and then, upon expiration of said second time interval, halting supply of power from said electric circuit to said metal halide lamp to thereby turn off said metal halide lamp.

5. An image display as recited in claim 4, wherein said at least one rare gas comprises argon gas having a partial pressure of 0.1 to 1000 Torr.

6. An image display as recited in claim 4, wherein said second time interval is less than 10 seconds.

7. A method of turning off a metal halide lamp in which arc discharge is taking place, comprising the steps of:

interrupting power supply to said metal halide lamp for a first time interval to allow cooling of said metal halide lamp;

upon expiration of said first time interval, supplying power to said metal halide lamp for a second time interval to cause redischarge; and upon expiration of said second time interval, halting supply of power to said metal halide lamp to thereby turn off said metal halide lamp.

8. A method as recited in claim 7, wherein said second time interval is less than 10 seconds.

* * * * *